US010513403B2

(12) United States Patent
Okada et al.

(10) Patent No.: US 10,513,403 B2
(45) Date of Patent: Dec. 24, 2019

(54) SHEET CONVEYING DEVICE AND IMAGE FORMING APPARATUS

(71) Applicant: KYOCERA Document Solutions Inc., Osaka (JP)

(72) Inventors: Seiji Okada, Osaka (JP); Takehiko Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/099,973

(22) PCT Filed: Apr. 20, 2017

(86) PCT No.: PCT/JP2017/015822
§ 371 (c)(1),
(2) Date: Nov. 8, 2018

(87) PCT Pub. No.: WO2017/199673
PCT Pub. Date: Nov. 23, 2017

(65) Prior Publication Data

US 2019/0144223 A1 May 16, 2019

(30) Foreign Application Priority Data

May 19, 2016 (JP) ..... 2016-100250

(51) Int. Cl.
*B65H 3/06* (2006.01)

(52) U.S. Cl.
CPC ..... *B65H 3/0669* (2013.01); *B65H 3/0684* (2013.01)

(58) Field of Classification Search
CPC ..... B65H 3/0669; B65H 3/0684; B65H 7/18
See application file for complete search history.

(56) References Cited

U.S. PATENT DOCUMENTS 4,605,215 A * 8/1986 Hyltoft ..... B65H 3/0661 271/10.04
2011/0024980 A1* 2/2011 Sekiya ..... B65H 3/0669 271/264

FOREIGN PATENT DOCUMENTS

JP 11-265096 A 9/1999

* cited by examiner

*Primary Examiner* — David H Bollinger
(74) *Attorney, Agent, or Firm* — Stein IP, LLC

(57) ABSTRACT

A sheet conveying device has a supporting frame that supports a pick-up roller and that moves downward when a sheet is fed, a stepping motor that rotates the pick-up roller and moves the supporting frame downward, and a control portion that starts driving the stepping motor when a job is started and then increases a frequency of the pulse signal to a target frequency. The control portion keeps the frequency of the pulse signal not more than ½ of the target frequency at least until the pick-up roller touches the sheet first.

5 Claims, 6 Drawing Sheets

SHEET CONVEYING DEVICE AND IMAGE FORMING APPARATUS

CROSS-REFERENCE TO RELATED APPLICATIONS

This application claims the benefit of International Application No. PCT/JP2017/015822, filed Apr. 20, 2017, which claims the benefit of Japanese Application No. 2016-100250 filed May 19, 2016, the disclosures of which are incorporated herein by reference.

TECHNICAL FIELD

The present invention relates to a sheet conveying device for conveying a sheet and an image forming apparatus.

BACKGROUND ART

To some image forming apparatuses provided with an image reading portion for reading a document (sheet), a sheet conveying device is fitted. In an image forming apparatus to which a sheet conveying device is fitted, conveyed-document reading can be performed. When a job involving conveyed-document reading is performed, a document is conveyed to an image reading position of the image reading portion by the sheet conveying device. Then, when the document being conveyed passes the reading position, the document is read by the image reading portion.

For example, the sheet conveying device is provided with a tray on which a document is placed, and conveys the document placed on the tray to the reading position. The sheet conveying device is provided with a pick-up roller for pulling the document out from the tray. The pick-up roller rotates by receiving a driving force from a stepping motor. As the pick-up roller touches the document placed on the tray while rotating, the document is pulled out from the tray (for example, see Patent Document 1).

LIST OF CITATIONS

Patent Literature

Patent Document 1: JP-A-H11-265096

SUMMARY OF THE INVENTION

Problem to be Solved by the Invention

To perform a job involving conveyed-document reading, a document needs to be placed on a tray in a sheet conveying device. When a document is placed on the tray, if the placement face of the tray touches a pick-up roller, it is difficult to place the document on the tray. Thus, according to some practiced methods, when no job is performed, the pick-up roller is retracted to a prescribed position (standby position) above the tray, and when a job is started, the pick-up roller is moved downward from the standby position.

For example, up-and-down movement of the pick-up roller is performed using the driving force of a stepping motor for rotating the pick-up roller. That is, when the stepping motor is driven, the pick-up roller moves downward while rotating.

In this structure, when the stepping motor is driven at the start of a job involving conveyed-document reading, the pick-up roller, while rotating, moves downward to collide against a document. Here, an impact acts on the pick-up roller, and this causes torque fluctuation in the stepping motor. Thus the stepping motor may go out of step. In that case, sheet feeding failure (such as a document jam) occurs.

The present invention is made to solve the above problem and its object is to provide a sheet conveying device and an image forming apparatus that can prevent occurrence of sheet feeding failure.

Means for Solving the Problem

To achieve the above object, a sheet conveying device according to the present invention is provided with a tray on which a sheet fed to a sheet conveying passage is placed, a pick-up roller which stands by at a prescribed standby position above the tray when not feeding the sheet and which, while rotating, moves downward to touch the sheet placed on the tray when feeding the sheet, a supporting frame which rotatably supports the pick-up roller above the tray and which, by moving downward when feeding the sheet, makes the pick-up roller touch the sheet placed on the tray, a stepping motor which rotates the pick-up roller and which moves the supporting frame downward, and a control portion which, when starting a job involving sheet conveyance, by inputting a pulse signal to the stepping motor and thereby starting to drive the stepping motor, makes the pick-up roller start to rotate and also makes the supporting frame start to move downward, and which then increases the frequency of the pulse signal input to the stepping motor to a prescribed target frequency. Then, after the job is started and at least until the pick-up roller first touches the sheet, the control portion keeps the frequency of the pulse signal input to the stepping motor not more than ½ of the target frequency.

In the structure according to the present invention, after a job involving sheet conveyance is started and at least until the pick-up roller first touches the sheet, the frequency of the pulse signal input to the stepping motor is kept not more than ½ of the target frequency. Thus it is possible to deliver an impact (an impact generated when the pick-up roller that starts to move downward at the start of a job collides against the sheet) on the pick-up roller when the torque of the stepping motor is comparatively high. With this, it is possible to prevent the stepping motor from going out of step after the start of a job due to the impact acting on the pick-up roller when the pick-up roller collides against the sheet (when the pick-up roller first touches the sheet). That is, occurrence of sheet feeding failure can be prevented.

Advantageous Effects of the Invention

With the structure according to the present invention, after a job involving sheet conveyance is started and at least until a pick-up roller first touches a sheet, the frequency of the pulse signal input to the stepping motor is kept not more than ½ of a target frequency and thus occurrence of sheet feeding failure can be prevented.

DESCRIPTION OF EMBODIMENTS

One embodiment of the present invention will be described taking as an example a multifunction peripheral incorporating a plurality of types of functions including a scanning function and a printing function.

<The Overall Structure of a Multifunction Peripheral>

Figure 1:
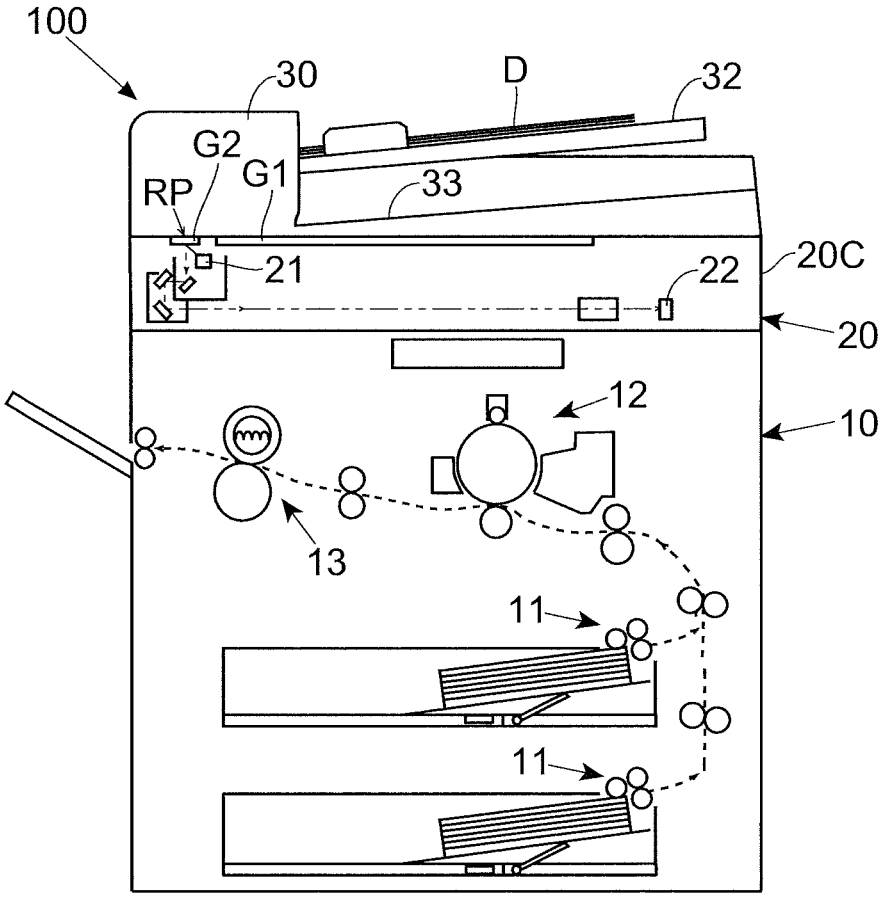
FIG. 1 A diagram showing the structure of a multifunction peripheral to which a document conveying device according to one embodiment of the present invention is fitted.

As shown in FIG. 1, a multifunction peripheral 100 (corresponding to an "image forming apparatus") according to this embodiment is provided with a printing portion 10. The printing portion 10 conveys sheets along paper conveying passages (indicated by broken lines in FIG. 1). The printing portion 10 forms a toner image based on image data of an image to be printed (for example, an image read by an image reading portion 20, which will be described later). The printing portion 10 prints (transfers) the toner image on a sheet being conveyed. The printing portion 10 includes, among others, a sheet feeding portion 11 which feeds a sheet stored in a sheet cassette to the paper conveying passage, an image forming portion 12 which forms a toner image and transfers the image to the sheet, and a fixing portion 13 which fixes the toner image transferred to the sheet.

The multifunction peripheral 100 is provided with an image reading portion 20 which optically reads documents D. The image reading portion 20 includes, among others, a lamp 21 and an image sensor 22. These components of the image reading portion 20 are housed inside a reading housing 20C. The image reading portion 20 performs placed-document reading by which a document D placed on a contact glass G1 is read.

Here, a document conveying device 30 is mounted on the reading housing 20C. The image reading portion 20 performs not only placed-document reading, but also conveyed-document reading by which a document D automatically conveyed by the document conveying device 30 is read. In conveyed-document reading, the document D set on the document conveying device 30 is conveyed onto the contact glass G2, and when the document D being conveyed passes a predetermined position (hereinafter referred to as a reading position RP) on the contact glass G2, the document D is read by the image reading portion 20. The document conveying device 30 corresponds to a "sheet conveying device".

<The Structure of the Document Conveying Device>

Figure 2:
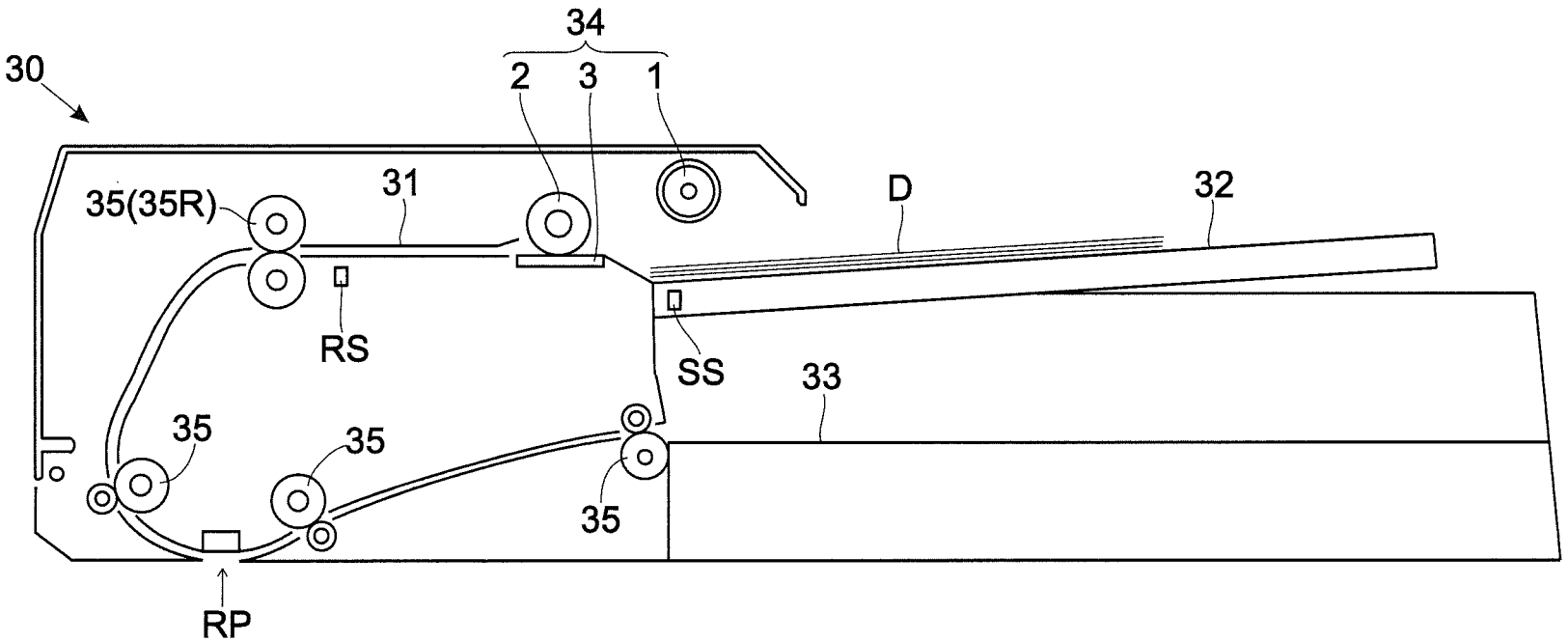
FIG. 2 A diagram showing the structure of the document conveying device according to the one embodiment of the present invention.

As shown in FIG. 2, the document conveying device 30 includes a document conveying passage 31 through which the document D as a target of conveyed-document reading is conveyed, a document set tray 32 on which the document D before being read is placed, and a document discharge tray 33 to which the document D having been read is discharged. The document conveying passage 31 extends from the document set tray 32 to the document discharge tray 33 via the reading position RP (a predetermined position on the contact glass G2) for conveyed-document reading. The document conveying passage 31 corresponds to a "sheet conveying passage", and the document set tray 32 corresponds to a "tray".

Here, the document conveying device 30 is provided with a sheet feeding mechanism 34. The sheet feeding mechanism 34 is arranged at a feeding port (at the upstream-side end of the document conveying passage 31 in the document conveying direction) through which the document D is fed from the document set tray 32 into the document conveying passage 31. The sheet feeding mechanism 34, during a job involving conveyed-document reading (job involving conveyance of the document D) such as a copy job, feeds the document D placed on the document set tray 32 to the document conveying passage 31. The structure of the sheet feeding mechanism 34 will be described in detail later.

The document conveying device 30 is provided with conveying roller pairs 35. A plurality of the conveying roller pairs 35 are arranged along the document conveying passage 31 and convey the document D fed to the document conveying passage 31. By being conveyed by these conveying roller pairs 35, the document D passes the reading position RP. The document D having passed the reading position RP is conveyed by the conveying roller pairs 35, and is discharged to the document discharge tray 33 in the end. Of the plurality of conveying roller pairs 35, the roller pair 35R to which the document D fed by the sheet feeding mechanism 34 reaches first is a registration roller pair for stopping the progress of the document D momentarily.

<The Structure of the Sheet Feeding Mechanism>

As shown in FIG. 2, the sheet feeding mechanism 34 includes a pick-up roller 1 and a sheet feeding roller 2. The pick-up roller 1 is arranged above a placement face (the face on which the document D is placed) of the document set tray 32. The pick-up roller 1 pulls out the document D placed on the document set tray 32 from the document set tray 32.

The sheet feeding roller 2 is arranged on the downstream side of the pick-up roller 1 in the sheet feeding direction. The sheet feeding roller 2 feeds the document D pulled out from the document set tray 32 to the document conveying passage 31. Under the sheet feeding roller 2, a friction pad 3 formed of cork or rubber is provided. The friction pad 3 forms a sheet feeding nip against the sheet feeding roller 2. The document D pulled out from the document set tray 32 enters the sheet feeding nip.

Figure 3:
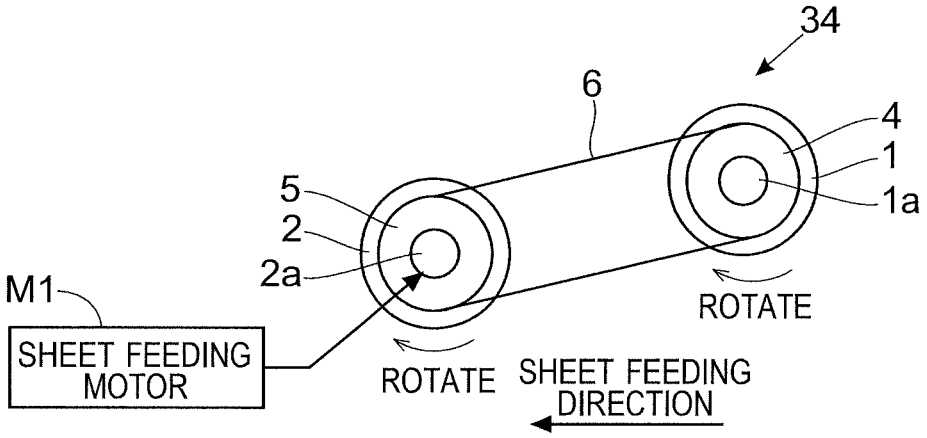
FIG. 3 A diagram showing the structure of a sheet feeding mechanism provided in the document conveying device according to the one embodiment of the present invention.

As shown in FIG. 3, a belt gear 4 is fitted to a rotary shaft 1*a* of the pick-up roller 1, and a belt gear 5 is fitted to a rotary shaft 2*a* of the sheet feeding roller 2. The belt gears 4 and 5 are coupled with each other by a belt 6. With this, when one of the belt gears 4 and 5 rotates, the other belt gear also rotates. That is, the pick-up roller 1 and the sheet feeding roller 2 rotate simultaneously.

To rotate the pick-up roller 1 and the sheet feeding roller 2 simultaneously, a sheet feeding motor M1 is provided in the document conveying device 30. The sheet feeding motor M1 is coupled with the rotary shaft 2*a* of the sheet feeding roller 2. The sheet feeding roller 2 (rotary shaft 2*a*) rotates as a driving force from the sheet feeding motor M1 is transmitted to it. Here, the pick-up roller 1 (rotary shaft 1*a*) and the sheet feeding roller 2 (rotary shaft 2*a*) rotate in the same direction. Although not illustrated, the driving force from the sheet feeding motor M1 may be transmitted from the sheet feeding roller 2 (rotary shaft 2*a*) to the pick-up roller 1 (rotary shaft 1*a*) via a gear train that includes a plurality of gears.

Figure 4:
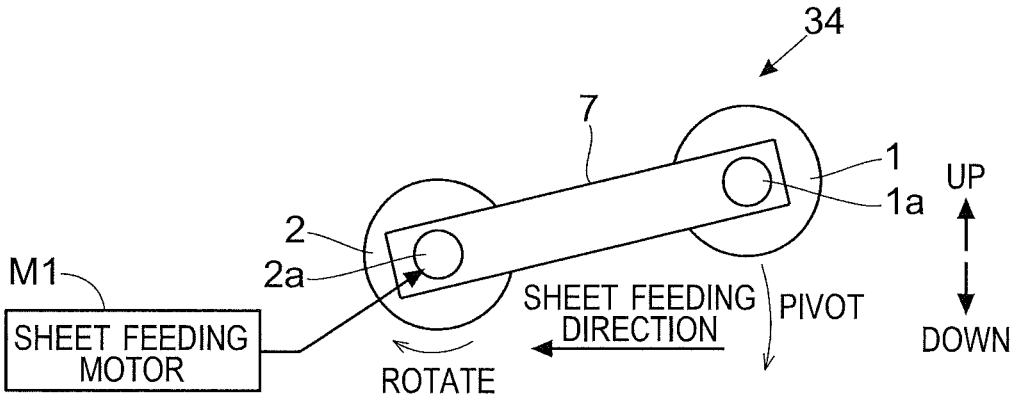
FIG. 4 A diagram showing the structure of the sheet feeding mechanism provided in the document conveying device according to the one embodiment of the present invention.

As shown in FIG. 4, the sheet feeding mechanism 34 includes a supporting frame 7. The supporting frame 7, above the placement face of the document set tray 32, rotatably supports the pick-up roller 1 (rotary shaft 1*a*).

The supporting frame 7 is coupled with the rotary shaft 2*a* of the sheet feeding roller 2. When the rotary shaft 2*a* of the sheet feeding roller 2 rotates (when the sheet feeding motor M1 is driven), the supporting frame 7 pivots, with the rotary shaft 2*a* of the sheet feeding roller 2 as a fulcrum, in such a way that a part of the supporting frame 7 on the pick-up roller 1 side (the part which rotatably supports the pick-up roller 1) swings in the up-down direction. The supporting frame 7 is coupled with the rotary shaft 2*a* of the sheet feeding roller 2 via, for example, a torque limiter (unillustrated).

<The Hardware Configuration of the Multifunction Peripheral>

Figure 5:
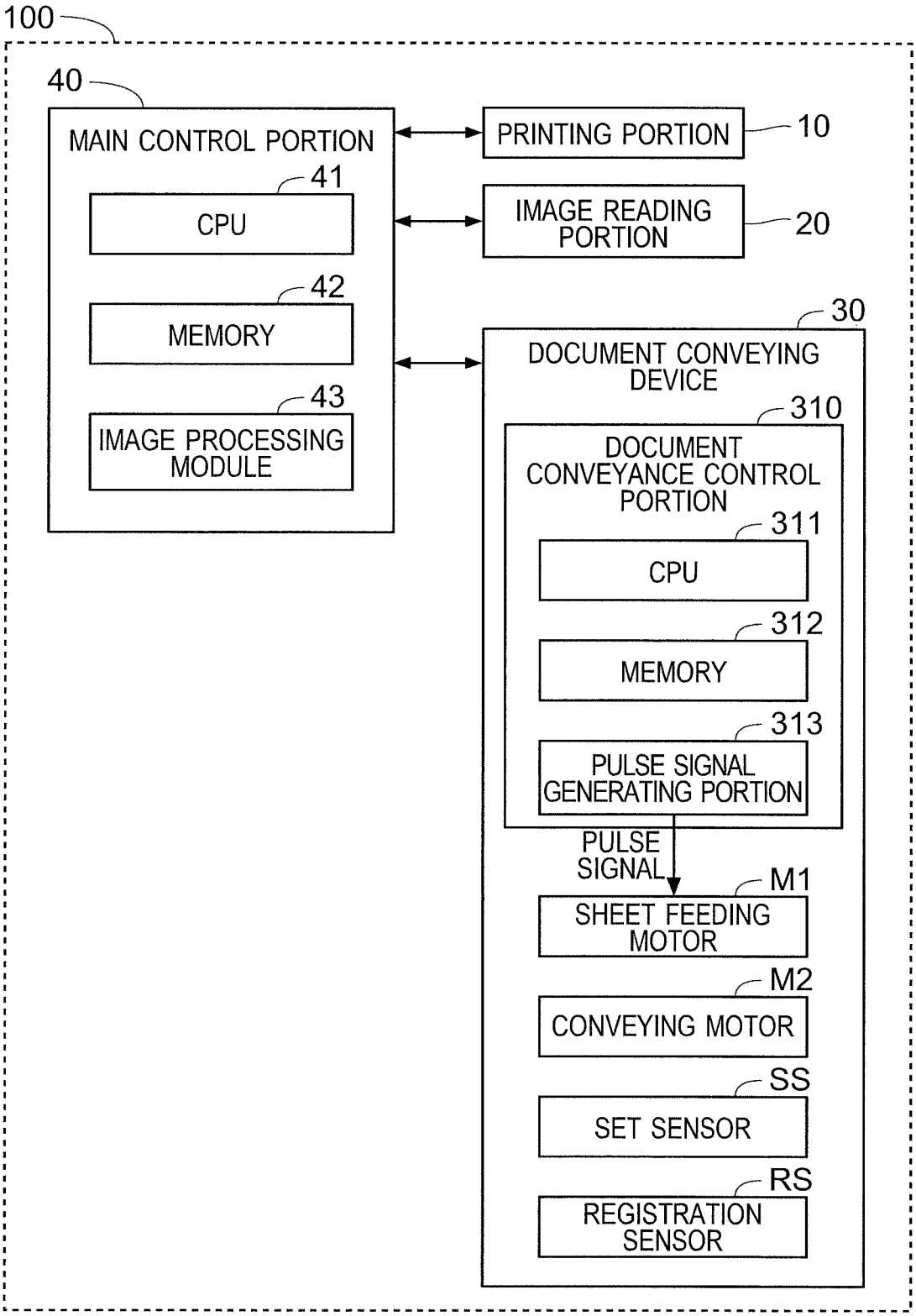
FIG. 5 A diagram showing the hardware structure of the multifunction peripheral to which the document conveying device according to the one embodiment of the present invention is fitted.

As shown in FIG. 5, the multifunction peripheral 100 is provided with a main control portion 40. The main control portion 40 includes a CPU 41, a memory 42 (such as ROM and RAM), and an image processing module 43. The CPU 41 operates based on a control program and data. The control program and data are stored in the memory 42. The image processing module 43 includes an image processing circuit and an image processing memory, and performs different kinds of image processing.

The main control portion 40 is connected to the printing portion 10 and the image reading portion 20. The main control portion 40 controls printing operation in the printing portion 10 and image reading operation in the image reading portion 20.

Here, the document conveying device 30 is provided with a document conveyance control portion 310 which is connected to the main control portion 40. The document conveyance control portion 310 includes a CPU 311 and a memory 312. The document conveyance control portion 310, in response to an instruction from the main control portion 40, controls document conveying operation in the document conveying device 30 when a job involving conveyed-document reading is executed. The document conveyance control portion 310 corresponds to a "control portion".

The document conveyance control portion 310, in controlling document conveying operation, controls the driving of motors for rotating various rotating members provided in the document conveying device 30 (rotates the various rotating members adequately). The motors controlled by the document conveyance control portion 310 include the sheet feeding motor M1 and a conveying motor M2. The sheet feeding motor M1 is a motor for rotating the rotating members (pick-up roller 1 and sheet feeding roller 2) in the sheet feeding mechanism 34. The conveying motor M2 is a motor for rotating the conveying roller pairs 35.

To the document conveyance control portion 310, various sensors including a set sensor SS and a registration sensor RS are connected. The set sensor SS is a sensor that changes its output value according to the presence or the absence of a document D on the document set tray 32. Based on the output value from the set sensor SS, the document conveyance control portion 310 senses whether the document D is placed on the document set tray 32 (whether an unread document D that should be fed remains on the document set tray 32).

The registration sensor RS is a sensor that changes its output value according to the presence or the absence of a document D at a position close to the registration roller pair 35R (on the upstream side of the registration roller pair 35R in the document conveying direction). Based on the output value from the registration sensor RS, the document conveyance control portion 310 senses whether a leading edge of the document D has reached a sensing position of the registration sensor RS or whether a trailing edge of the document D has passed the sensing position of the registration sensor RS. For example, the document conveyance control portion 310 judges, based on the output value from the registration sensor RS, whether the leading edge of the document D fed from the sheet feeding mechanism 34 has reached the registration roller pair 35R.

<Sheet Feeding Operation in the Sheet Feeding Mechanism>

Sheet feeding operation performed by the document conveying device 30 will be described below with reference to FIG. 6. The main control portion 40, when starting a job involving conveyed-document reading, sends an instruction to start the job to the document conveyance control portion 310. The document conveyance control portion 310, upon receiving an instruction to start the job from the main control portion 40, feeds a document D from the document set tray 32 to the document conveying passage 31, and conveys the document D along the document conveying passage 31. That is, the document conveyance control portion 310 drives the sheet feeding motor M1, and in addition drives the conveying motor M2.

Figure 6:
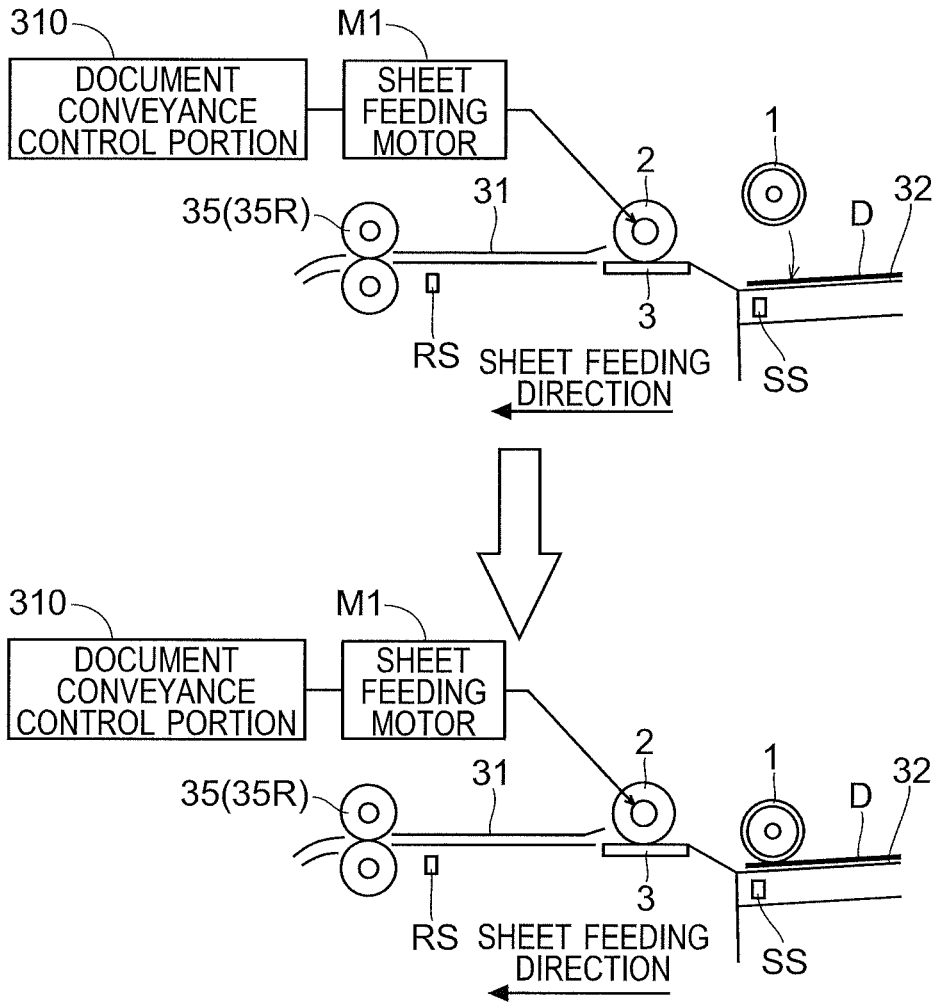
FIG. 6 A diagram for explaining sheet feeding operation in the document conveying device according to the one embodiment of the present invention.

Here, as shown in FIG. 6 (in the upper part of it), at the start of a job, the pick-up roller 1 is held at a prescribed standby position. For example, in a state where a document D containing the maximum placeable number of sheets (the maximum number of sheets in the document D placeable on the document set tray 32 at once) is placed on the document set tray 32, the standby position of the pick-up roller 1 is set at a position where the interval between the topmost layer of the document D on the document set tray 32 and the pick-up roller 1 is larger than a prescribed threshold value. That is, at the start of a job, the document D on the document set tray 32 does not touch the pick-up roller 1.

When starting the feeding of the document D, the document conveyance control portion 310 starts to drive the sheet feeding motor M1 (makes the sheet feeding motor M1 rotate forward). With this, the pick-up roller 1 (rotary shaft 1*a*) and the sheet feeding roller 2 (rotary shaft 2*a*) rotate forward. In other words, the pick-up roller 1 and the sheet feeding roller 2 rotate in such a direction as to feed the document D.

Here, as the rotary shaft 2*a* of the sheet feeding roller 2 rotates forward, the supporting frame 7 (see FIG. 4) pivots downward. That is, the pick-up roller 1 supported on the supporting frame 7 moves downward. With this, the pick-up roller 1, while rotating forward, touches the document D, shifting from a state as shown in the upper part of FIG. 6 to a state as shown in the lower part of it.

The supporting frame 7 is coupled with the rotary shaft 2*a* of the sheet feeding roller 2 via, for example, a torque limiter (unillustrated). Thus, within a range where the pivoting of the supporting frame 7 is not restricted, the rotation force of the sheet feeding roller 2 (rotary shaft 2*a*) is transmitted to the supporting frame 7. That is, the supporting frame 7 pivots downward until the pick-up roller 1 touches the document D. Once the pick-up roller 1 touches the document D, the pivoting of the supporting frame 7 shifts into a restricted state, and thus the rotation force of the sheet feeding roller 2 (rotary shaft 2*a*) is not transmitted to the supporting frame 7 anymore. That is, the supporting frame 7 does not pivot anymore, but the pick-up roller 1 and the sheet feeding roller 2 continue rotating forward.

When the pick-up roller 1, while rotating forward, touches the document D, the document D that touches the pick-up roller 1 is pulled out from the document set tray 32 in the sheet feeding direction and enters the sheet feeding nip between the sheet feeding roller 2 and the friction pad 3. Here, the sheet feeding roller 2 is rotating forward, and thus the document D that has entered the sheet feeding nip is fed out in the sheet feeding direction. That is, the document D is fed to the document conveying passage 31.

The document D fed to the document conveying passage 31 is conveyed by the pick-up roller 1 and the sheet feeding roller 2 and reaches the sensing position of the registration sensor RS. With this, the document conveyance control portion 310 senses that the leading edge of the document D has reached the sensing position of the registration sensor RS.

Then, the document conveyance control portion 310 judges, based on the elapsed time since the arrival of the leading edge of the document D, whether the leading edge of the document D has reached the registration roller pair 35R. The document conveyance control portion 310, upon judging that the leading edge of the document D has reached the registration roller pair 35R, stops the forward rotation of the pick-up roller 1 and the sheet feeding roller 2. For example, the sheet feeding motor M1 and the rotary shaft 2*a* of the sheet feeding roller 2 are coupled together via a sheet feeding clutch (unillustrated), and the forward rotation of the pick-up roller 1 and the sheet feeding roller 2 is stopped by turning the clutch off.

When the previously fed document D is read (for example, when the previous document D is discharged to the document discharge tray 33), the document conveyance control portion 310 judges, based on the output value from the set sensor SS, whether an unread document D that should be fed next remains on the document set tray 32. If the document conveyance control portion 310 judges that the next document D remains, the sheet feeding clutch is turned on, and the forward rotation of the pick-up roller 1 and the sheet feeding roller 2 is restarted. With this, the next document D is fed.

On the other hand, if the document conveyance control portion 310 judges that the next document D is not left, it stops driving the sheet feeding motor M1. Then, the document conveyance control portion 310 starts driving the sheet feeding motor M1 again. Here, the document conveyance control portion 310 rotates the sheet feeding motor M1 backward. With this, the supporting frame 7 (see FIG. 4) pivots upward, and the pick-up roller 1 moves upward. Then, when the pick-up roller 1 reaches the standby position, the document conveyance control portion 310 stops driving the sheet feeding motor M1.

<The Driving Control for the Sheet Feeding Motor>

As shown in FIG. 5, a pulse signal is input to the sheet feeding motor M1 (a stepping motor). Then, the sheet feeding motor M1 rotates at a speed corresponding to the frequency of the pulse signal. To control the driving of the sheet feeding motor M1, the document conveyance control portion 310 includes a pulse signal generating portion 313.

Figure 7:
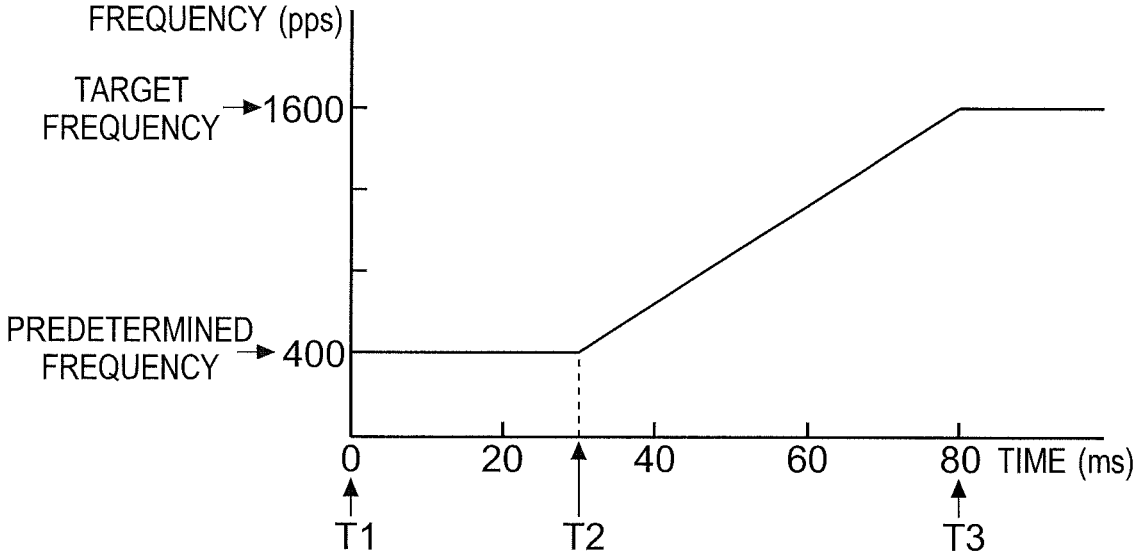
FIG. 7 A diagram for explaining sheet feeding operation in the document conveying device according to the one embodiment of the present invention (a graph showing the relationship between the elapsed time since the start of a job and the driving frequency of a sheet feeding motor).

The pulse signal generating portion 313 generates a pulse signal input to the sheet feeding motor M1. The document conveyance control portion 310 (pulse signal generating portion 313) controls, by changing the frequency of the pulse signal, the rotation speed of the sheet feeding motor M1. A more specific description will be given below with reference to FIG. 7.

When starting a job involving conveyed-document reading (when starting the feeding of the document D), that is, when the pick-up roller is in the standby position, the document conveyance control portion 310 starts driving the sheet feeding motor M1 by inputting a pulse signal of a predetermined frequency within a self-start range (a frequency lower than or equal to the maximum self-start frequency) to the sheet feeding motor M1. With this, the pick-up roller 1 and the sheet feeding roller 2 each start rotating forward, and in addition the supporting frame 7 starts pivoting downward (at a time point T1). For example, the predetermined frequency is the maximum self-start frequency of the sheet feeding motor M1, and is set to 400 pps (Hz).

Then, the document conveyance control portion 310 gradually increases the frequency of the pulse signal input to the sheet feeding motor M1 from the predetermined frequency to a prescribed target frequency, and eventually brings the frequency of the pulse signal input to the sheet feeding motor M1 to the target frequency (at a time point T3). The target frequency is a frequency higher than the maximum self-start frequency (a frequency higher than the predetermined frequency) of the sheet feeding motor M1, and is set to, for example, 1600 pps (Hz). That is, the target frequency is four times the predetermined frequency that is the frequency at the start of the job (the predetermined frequency is not more than ½ of the target frequency).

After bringing the frequency of the pulse signal input to the sheet feeding motor M1 to the target frequency, the document conveyance control portion 310 maintains the frequency of the pulse signal input to the sheet feeding motor M1 at the target frequency until conveyed-document reading is completed (until all the sheets of the document D placed on the document set tray 32 are fed). Once conveyed-document reading is completed, the document conveyance control portion 310 gradually decreases the frequency of the pulse signal input to the sheet feeding motor M1, and eventually stops the driving of the sheet feeding motor.

Here, the document conveyance control portion 310, after the job involving conveyed-document reading is started and at least until the pick-up roller 1 first touches a document D, maintains the frequency of the pulse signal input to the sheet feeding roller M1 at the predetermined frequency (the frequency at the start of the job). With this, the sheet feeding motor M1 is driven with a pulse signal of a predetermined frequency after the job involving conveyed-document reading is started and at least until the pick-up roller 1 first touches the document D. That is, at a time point when, after a job is started, the pick-up roller 1 first touches the document D, the frequency of the pulse signal input to the sheet feeding motor M1 is the predetermined frequency.

For example, after the job involving conveyed-document reading is started and until a prescribed threshold time passes, the document conveyance control portion 310 maintains the frequency of the pulse signal input to the sheet feeding motor M1 at the predetermined frequency (the frequency at the start of the job). Then, the document conveyance control portion 310, when the elapsed time since the start of the job reaches the threshold time, increases the frequency of the pulse signal input to the sheet feeding motor M1 from the predetermined frequency to the target frequency (at a time point T2).

Assuming that the number of sheets in the document D placed on the document set tray 32 is one and that the frequency of the pulse signal input to the sheet feeding motor M1 is the predetermined frequency (400 ms), the threshold time used to control the sheet feeding motor M1 is the time which the pick-up roller 1 needs to move from the standby position to the position where it touches the document D on the document set tray 32. The threshold time is set to, for example, 30 ms.

Figure 8:
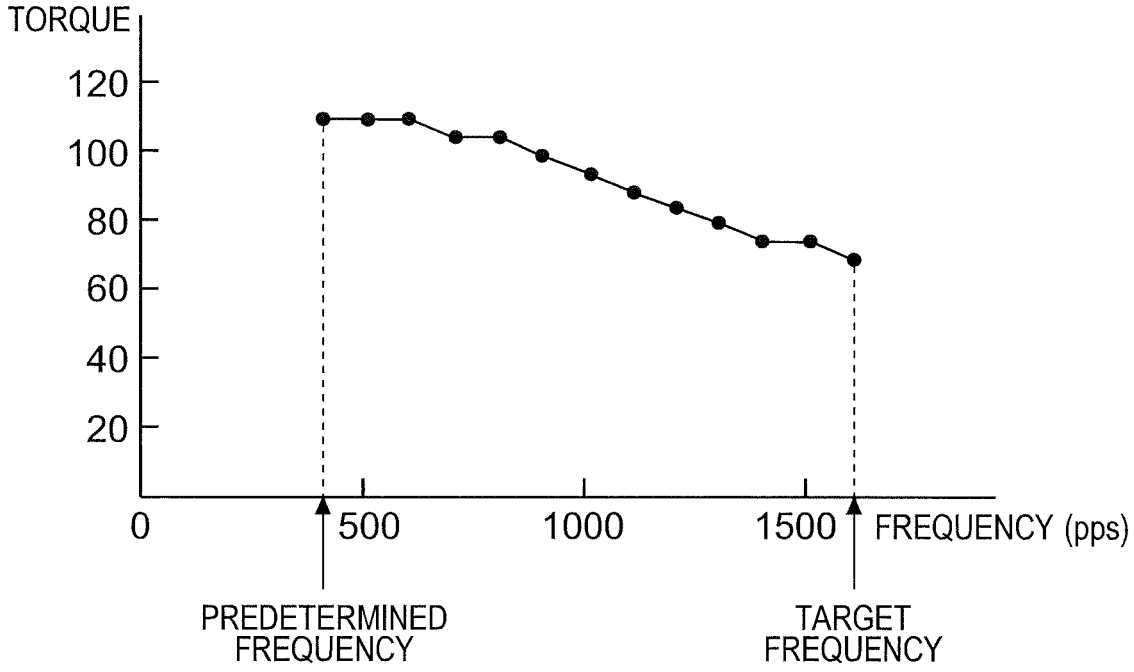
FIG. 8 A graph showing the relationship between the driving frequency of the sheet feeding motor provided in the document conveying device according to the one embodiment of the present invention and torque.

With this, if the document D placed on the document set tray 32 has a plurality of sheets, the pick-up roller 1 touches the document D before the elapsed time since the start of the job reaches the threshold time. If the document D placed on the document set tray 32 has one sheet, the pick-up roller 1 touches the document D when the elapsed time since the start of the job reaches the threshold time. In either case, when the sheet feeding motor M1 is being driven with the pulse signal of the predetermined frequency (400 pps), which is the driving frequency at the start of the job, the pick-up roller 1 touches the document D. Thus, as shown in FIG. 8, the pick-up roller 1 touches the document D during a low-speed period (when the sheet feeding motor M1 is driving at 400 pps) when a high torque can be generated.

The driving frequency of the sheet feeding motor M1 after the start of a job involving conveyed-document reading and until a threshold time passes may be any frequency not more than ½ of the target frequency. For example, the driving frequency of the sheet feeding motor M1 after the start of the job may be increased within a range where the driving frequency of the sheet feeding motor M1 at the time point when the elapsed time since the start of a job reaches the threshold time is not more than ½ of the target frequency.

A touch detection sensor that senses whether the pick-up roller 1 touches a document D on the document set tray 32 may be separately arranged. The frequency of the pulse signal input to the sheet feeding motor M1 may be, after a job involving conveyed-document reading is started and until the document conveyance control portion 310 senses that the pick-up roller 1 touches the document D, maintained at a predetermined frequency (a frequency at the start of a job), and after the document conveyance control portion 310 senses that the pick-up roller 1 touches the document D, the frequency of the pulse signal input to the sheet feeding motor M1 may be increased from the predetermined frequency to the target frequency.

Figure 9:
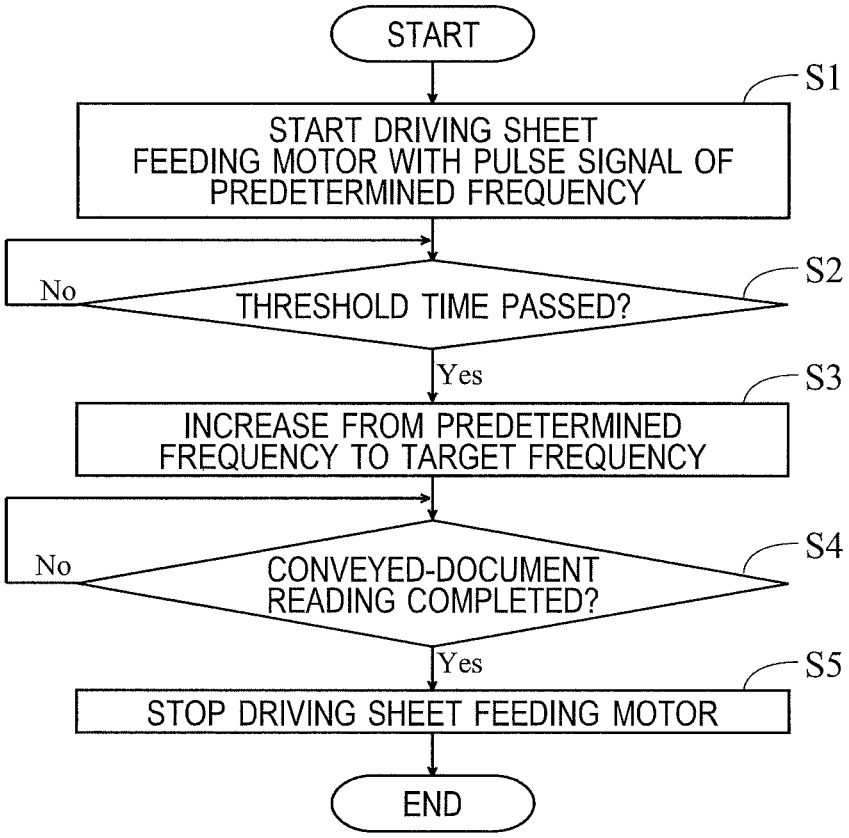
FIG. 9 A flow chart for explaining the process of driving control for the sheet feeding motor provided in the document conveying device according to the one embodiment of the present invention.

The process of driving control for the sheet feeding motor M1 will be described below with reference to a flow chart shown in FIG. 9. The flow chart shown in FIG. 9 starts when the document conveyance control portion 310 receives an instruction to start a job involving conveyed-document reading from a main control portion 40.

In step S1, the document conveyance control portion 310 starts the driving of the sheet feeding motor M1 by inputting the pulse signal of the predetermined frequency (400 pps) to the sheet feeding motor M1. With this, the pick-up roller 1 and the sheet feeding roller 2 start rotating forward. The supporting frame 7 starts pivoting downward.

In step S2, the document conveyance control portion 310 judges whether the elapsed time since the start of the job has reached the threshold time. If the document conveyance control portion 310 judges that the elapsed time has reached the threshold time, the process proceeds to step S3. On the other hand, if the document conveyance control portion 310 judges that the elapsed time has not reached the threshold time, the judgement in step S2 is repeated.

When the step proceeds to step S3, the document conveyance control portion 310 gradually increases the frequency of the pulse signal input to the sheet feeding motor M1 from the predetermined frequency (400 pps) that is the frequency at the start of the job to the target frequency (1600 pps).

In step S4, the document conveyance control portion 310 judges whether conveyed-document reading has been completed. If the document conveyance control portion 310 judges conveyed-document reading has been completed, the process proceeds to step S5. On the other hand, if the document conveyance control portion 310 judges conveyed-document reading is not completed, the judgement in step 4 is repeated.

When the process proceeds to step S5, the document conveyance control portion 310 stops driving the sheet feeding motor M1.

In the structure according to this embodiment, as described above, in starting a job involving conveyed-document reading, after the driving of the sheet feeding motor M1 is started by inputting the pulse signal of the predetermined frequency (which is a frequency not more than the maximum self-start frequency and is a frequency not more than ½ of the target frequency) to the sheet feeding motor M1, and at least until the pick-up roller 1 first touches the document D, the frequency of the pulse signal input to the sheet feeding motor M1 is maintained at the predetermined frequency (the frequency at the start of a job). Thus it is possible to deliver an impact (an impact generated when the pick-up roller 1 that starts to move downward at the start of the job collides against the document D) on the pick-up roller 1 when the torque of the sheet feeding motor M1 is comparatively high. With this, it is possible to prevent the sheet feeding motor M1 from going out of step after the start of a job due to the impact acting on the pick-up roller 1 when the pick-up roller 1 collides against the document D. As a result, occurrence of sheet feeding failure can be prevented.

In the structure according to this embodiment, as described above, the frequency of the pulse signal input to the sheet feeding motor M1 is maintained at the predetermined frequency (frequency at the start of a job), and once the threshold time has passed, the frequency of the pulse signal input to the sheet feeding motor M1 is increased from the predetermined frequency to the target frequency. Thus, even if the document D placed on the document set tray 32 has the minimum number of sheets (that is, one), the driving frequency of the sheet feeding motor M1 when the pick-up roller 1 first touches the document D is the predetermined frequency. That is, regardless of the number of sheets in the document D placed on the document set tray 32, occurrence of sheet feeding failure can be prevented.

In the structure according to this embodiment, the pick-up roller 1 collides against the document D (the pick-up roller 1 first touches the document D after the start of a job) at a time point when the rotation speed of the pick-up roller 1 is comparatively slow, and the impact sound (unpleasant sound for a user) generated on collision can be reduced.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

The invention claimed is:

1. A sheet conveying device, comprising:

a tray on which a sheet fed to a sheet conveying passage is placed;

a pick-up roller which stands by at a prescribed standby position above the tray when not feeding the sheet and which, while rotating, moves downward to touch the sheet placed on the tray when feeding the sheet;

a supporting frame which rotatably supports the pick-up roller above the tray and which, by moving downward when feeding the sheet, makes the pick-up roller touch the sheet placed on the tray;

a stepping motor which rotates the pick-up roller and which moves the supporting frame downward; and a control portion which, when starting a job involving sheet conveyance, by inputting a pulse signal to the stepping motor and thereby starting to drive the stepping motor, makes the pick-up roller start to rotate and also makes the supporting frame start to move downward, the control portion then increasing a frequency of the pulse signal input to the stepping motor to a prescribed target frequency, wherein after the job is started and at least until the pick-up roller first touches the sheet, the control portion keeps the frequency of the pulse signal input to the stepping motor not more than ½ of the target frequency.

2. The sheet conveying device according to claim 1, wherein after the job is started and at least until the pick-up roller touches the sheet, the control portion keeps the frequency of the pulse signal input to the stepping motor not more than a maximum self-start frequency of the stepping motor.

3. The sheet conveying device according to claim 1, wherein after the job is started and at least until the pick-up roller touches the sheet, the control portion keeps the frequency of the pulse signal input to the stepping motor at a frequency at a start of the job.

4. The sheet conveying device according to claim 3, wherein after the job is started and until a prescribed threshold time passes, the control portion keeps the frequency of the pulse signal input to the stepping motor at the frequency at the start of the job, and the control portion increases, after the threshold time passes, the pulse signal input to the stepping motor to the target frequency, and the threshold time is, when a number of sheets placed on the tray is one and the frequency of the pulse signal input to the stepping motor is the frequency at the start of the job, time which the pick-up roller needs to move from the standby position to a position where the pick-up roller touches a document on the tray.

5. An image forming apparatus comprising the sheet conveying device according to claim 1.

* * * * *